US007078662B2

(12) United States Patent
Yoshidome

(10) Patent No.: US 7,078,662 B2
(45) Date of Patent: Jul. 18, 2006

(54) DRAWER-TYPE MICROWAVE HEATING COOKER

(75) Inventor: Akihiro Yoshidome, Osaka-fu (JP)

(73) Assignee: Sharp Kabushiki Kaisha, Osaka-fu (JP)

( * ) Notice: Subject to any disclaimer, the term of this patent is extended or adjusted under 35 U.S.C. 154(b) by 0 days.

(21) Appl. No.: 11/181,504

(22) Filed: Jul. 14, 2005

(65) Prior Publication Data

US 2006/0016350 A1 Jan. 26, 2006

(30) Foreign Application Priority Data

Jul. 23, 2004 (JP) ..... 2004-216324

(51) Int. Cl.
*H05B 6/64* (2006.01)

(52) U.S. Cl. ..... 219/756; 219/763; 219/403; 129/340

(58) Field of Classification Search ..... 219/756–758, 219/762–763, 403; 126/339–340
See application file for complete search history.

(56) References Cited

U.S. PATENT DOCUMENTS

| | | | | |
|---|---|---|---|---|
| 4,814,571 | A * | 3/1989 | Bowen et al. | 219/763 |
| 2004/0050841 | A1* | 3/2004 | Han et al. | 219/756 |
| 2005/0173399 | A1* | 8/2005 | Yoshidome et al. | 219/403 |

FOREIGN PATENT DOCUMENTS

| | | |
|---|---|---|
| JP | 03-045820 | 2/1991 |
| JP | 06-109257 | 4/1994 |
| JP | 11-237053 | 8/1999 |

* cited by examiner

*Primary Examiner*—Philip H. Leung
(74) *Attorney, Agent, or Firm*—Renner, Otto, Boisselle and Sklar, LLP

(57) ABSTRACT

A drawer-type heat cooker is provided in which a sliding mechanism for drawing out and pushing in a drawer body in a cooker body and a drive mechanism for driving the sliding mechanism are arranged separately from the heat chamber. As a result, these mechanisms can be prevented from being exposed to microwave in the heat chamber and leavings of food. The drawer body can be moved on the outside of the heat chamber with respect to the cooker body via left and right slide rails as a sliding mechanism and a slide rail at a center provided with the drive mechanism. The respective slide rails and the drive mechanism are prevented from being affected by high temperature, microwave, or leavings of food which may cause breakdown.

3 Claims, 3 Drawing Sheets

DRAWER-TYPE MICROWAVE HEATING COOKER

The present application is based on and claims priority of Japanese patent application No. 2004-216324 filed on Jul. 23, 2004, the entire contents of which are hereby incorporated by reference.

BACKGROUND OF THE INVENTION

1. Field of the Invention

The present invention relates to a drawer-type heat cooker in which a heating container can be drawn out toward the front from a cooker body.

2. Description of the Related Art

In the related art, as a heat cooker such as an electronic oven, a number of heat cookers of a front-door type are proposed. On the other hand, as a cooker of a type different from the front-door type, there is proposed a heat cooker of a drawer-type which is drawn out toward the front. Since the drawer-type heat cooker is suitable for a relatively large structure, it is considered as a cooker which constitutes a built-in kitchen.

As an example of the drawer-type heat cooker, a structure in which a bottom plate which moves in conjunction with the front door is adapted to be capable of smooth sliding movement with respect to an apparatus body with a sliding mechanism, and an output of a motor provided on the main body of the apparatus is transmitted by transmission means such as a pinion-rack mechanism to open and close the bottom plate together with the opening-closing door is proposed (Japanese Unexamined Patent Application Publication No. 3-45820 (P.3, upper left column, line 5 to the upper right column line 16, FIG. 2 to FIG. 4). A door opening-closing unit includes a latch device for holding the opening-closing door in a closed state, a door opening-closing switch, and a control circuit for driving the motor to open and close the opening-closing door upon reception of a signal from the door opening-closing switch, and when the door opening-closing switch is pressed, the latch is released automatically, and the opening-closing door and the bottom plate open and close in conjunction with each other by a drive force of the motor.

As another example of the drawer-type heat cooker, there is proposed a heat cooker in which a drawer body in which an object to be heated is stored is provided in a cooker body so as to be capable of being drawn out, in which when the fact that the drawer body is pulled toward the operator is detected, an electromagnetic leg portion provided on a bottom surface of the cooker body is excited to attract a metallic placing table on which the cooker is placed (See Japanese Unexamined Patent Application Publication No. 6-109257 Paragraph [0010] FIG. 1). With a structure in which the electromagnetic leg portion is attracted to the metallic placing table when the drawer body in which a large amount of object to be heated is stored is drawn out, the drawer body is prevented from being unstable in weight balance and falling down forward from the kitchen counter.

As still another example of the drawer-type heat cooker, there is proposed an electronic oven having a drawer structure in which a food placing table can be moved (See Japanese Unexamined Patent Application Publication No.11-237053 (paragraph [0030]-[0035], FIG. 1). The electronic oven is provided with a heating container having an opening on top so as to be freely drawn out from a body enclosure of the electronic oven, and the heating container and a lid member for covering the opening of the heating container provided on the body enclosure entrap microwave to define a heat chamber. In this electronic oven, a choke groove is provided between the peripheral edge of the opening of the heating container and the lid member opposing thereto to prevent leakage of electric wave.

The present applicant proposes a heat cooker provided with a drawer body in which an object to be heated is stored so as to be capable of drawing out from the cooker body (Japanese Patent Application No. 2004-7384, Japanese Patent Application No. 2004-7385). According to a proposal in the former application, necessity of using expensive components or materials having high heat-resistant property and fire-resistant property for forming a moving mechanism is avoided, and hence manufacturing cost can be reduced. Also, with a structure in which the moving mechanism is not affected by microwave irradiated in the heat chamber, a risk of discharging caused by microwave can be solved. According to the latter application, with a structure in which vibrations in association with opening and closing operation is applied to the object to be heated, a user is protected from a risk of burning himself/herself due to a phenomenon such that vapor is abruptly discharged from overheated liquid due to an impact such as vibrations, and, with a structure in which the moving speed of the opening-closing door is controlled, the object to be heated is prevented from falling down or liquid component is prevented from spilling out.

In a drawer-type heat cooker provided with a sliding mechanism on a bottom plate which is moved in conjunction with the opening-closing door and a motor for driving the same in order to open and close the opening-closing door automatically, when the components, in particular the motor is installed in the heat chamber, the components of the motor may be damaged by discharging caused by microwave or increase in temperature, which may result in breakdown. Also, when the sliding mechanism and driving motor is installed in the heat chamber, leavings of food as the object to be heated placed in the heat chamber may attach thereto, thereby causing corrosion or clogging and also resulting in breakdown.

Therefore, in the drawer-type heat cooker in which the heating container can be drawn out toward the front with respect to the cooker body, there are problems to be solved for improving arrangement of the sliding mechanism for enabling movement of the drawer body for automatically pulling and pushing the drawer body including the heating container and a drive mechanism for driving the sliding mechanism with respect to the heat chamber in order to prevent these mechanisms from being affected by microwave or the leavings of food.

SUMMARY OF THE INVENTION

Accordingly, it is an object of the present invention to provide a drawer-type heat cooker in which a heating container can be drawn out toward the front with respect to a cooker body, wherein arrangement of a sliding mechanism for automatically pulling and pushing a drawer body including the heating container and the drive mechanism for driving the sliding mechanism with respect to a heat chamber is considered, whereby the sliding mechanism and the drive mechanism are prevented from being exposed to microwave or leavings of food in the heat chamber, thereby preventing breakdown.

In order to solve the above-described problems, a drawer-type heat cooker according to the invention includes a cooker body including a heat chamber for heating with microwave therein, a drawer body movably disposed between a stored position in the heat chamber and a drawn-out position outside the heat chamber with respect to the cooker body, a sliding mechanism enabling the drawer body to move with respect to the cooker body, and a drive mechanism for driving the sliding mechanism, wherein the sliding mechanism and the drive mechanism are arranged outside the heat chamber.

According to the drawer-type heat cooker of the invention, when the drawer body is moved to a drawn-out position on the outside, the object to be heated can be placed on the drawer body. When the drawer body is in the stored position in the heat chamber, the object placed on the drawer body can be heated with microwave. Since both of the sliding mechanism for enabling the drawer body to slide with respect to the cooker body and the drive mechanism for driving the sliding mechanism are disposed outside the heat chamber, they are not affected by discharging due to microwave or increase in temperature in the heat chamber which may cause breakdown, and attachment of leavings of food which may also cause breakdown may also be prevented.

In the drawer-type heat cooker of the invention, the sliding mechanism includes a central sliding mechanism disposed at least outside below the center of the heat chamber, and the drive mechanism can be provided for driving the central sliding mechanism. Since the drive mechanism can provide a sufficient performance by being arranged at one single position, it can be provided as a mechanism for driving the central sliding mechanism disposed outside below the center of the heat chamber. In this case, the drawer body can be moved stably in a state of well balanced in the lateral direction. In addition to the central sliding mechanism, left and right sliding mechanisms may be arranged additionally on the outside on the left and right sides of the heat chamber. In this case, the drawer body can be moved further stably while being supported by the sliding mechanisms at least on the outside on the left and right sides and below the center of the heat chamber.

In the drawer-type heat cooker, the drive mechanism may include a rack-pinion mechanism including a drive motor mounted to the cooker body, a pinion to be rotated by the drive motor and a rack mounted to the drawer body and meshed with the pinion. The output rotation of the drive motor is converted into a sliding movement of the drawer body via the rack-pinion mechanism. The sliding mechanism includes a fixed rail mounted to the cooker body and a movable rail attached to the drawer body and being movable relatively with respect to the fixed rail, whereby the rack of the drive mechanism can be mounted to the movable rail. In this case, the output rotation of the drive motor is converted and transmitted from the pinion to the rack and further to the movable rail to which the rack is mounted to the drawer body as a sliding movement.

In the drawer-type heat cooker of the invention, the drawer body is provided with a heating container, and an opening-closing door mounted to the heating container and mounted with the movable rail, wherein an opening of the heat chamber is closed by the opening-closing door and the heating container is stored in the heat chamber in a state in which the drawer body is in the stored position. According to the drawer-type heat cooker in this arrangement, with a structure in which the opening of the heat chamber is closed by the opening-closing door and the heating container is stored in the heat chamber in a state in which the drawer body is in the stored position, microwave to be irradiated in the heat chamber is prevented from leaking outside.

In the drawer-type heat cooker of the invention, the cooker body is provided with a front panel for surrounding the opening of the heat chamber with which the opening-closing door comes into abutment in a state in which the drawer body is in the stored position, and the movable rail can be moved in and out from the cooker body through an insertion hole formed on the front panel. With the structure in which the movable rail is inserted through the insertion hole formed on the front panel, the sliding mechanism and the drive mechanism are arranged separately from the heat chamber, whereby the sliding mechanism or the drive mechanism is reliably prevented from being affected by microwave irradiated in the heat chamber or leavings of food which may be spattered or spilled in the heat chamber.

As described above, since the drawer-type heat cooker according to the invention includes a cooker body having the heat chamber for heating with microwave therein, the drawer body movably disposed with respect to the cooker body, the sliding mechanism enabling the drawer body to move with respect to the cooker body and the drive mechanism for driving the sliding mechanism, and the sliding mechanism and the drive mechanism are arranged outside the heat chamber, the sliding mechanism and the drive mechanism are prevented from being affected by discharge caused by microwave in the heat chamber and increase in temperature, and from attachment of leavings generated from the food as the object to be heated. Therefore, the drawer-type heat cooker is prevented from being affected by the microwave or the leavings of the food which may cause breakdown of the sliding mechanism and the drive mechanism. Therefore, stable operation for a long term is achieved.

DESCRIPTION OF THE PREFERRED EMBODIMENTS

Figure 1:
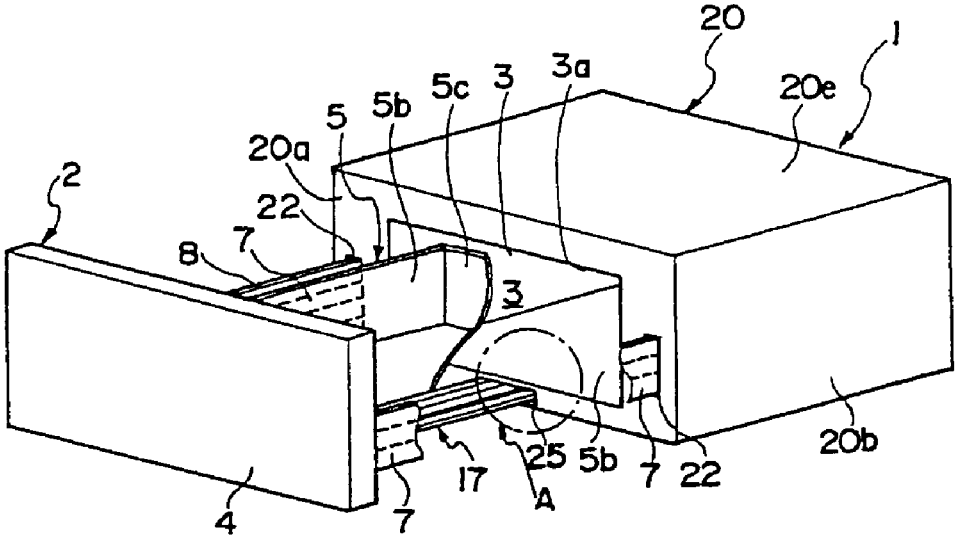
FIG. 1 is a perspective view of a general appearance of an embodiment of a drawer-type heat cooker according to the invention.
Figure 2:
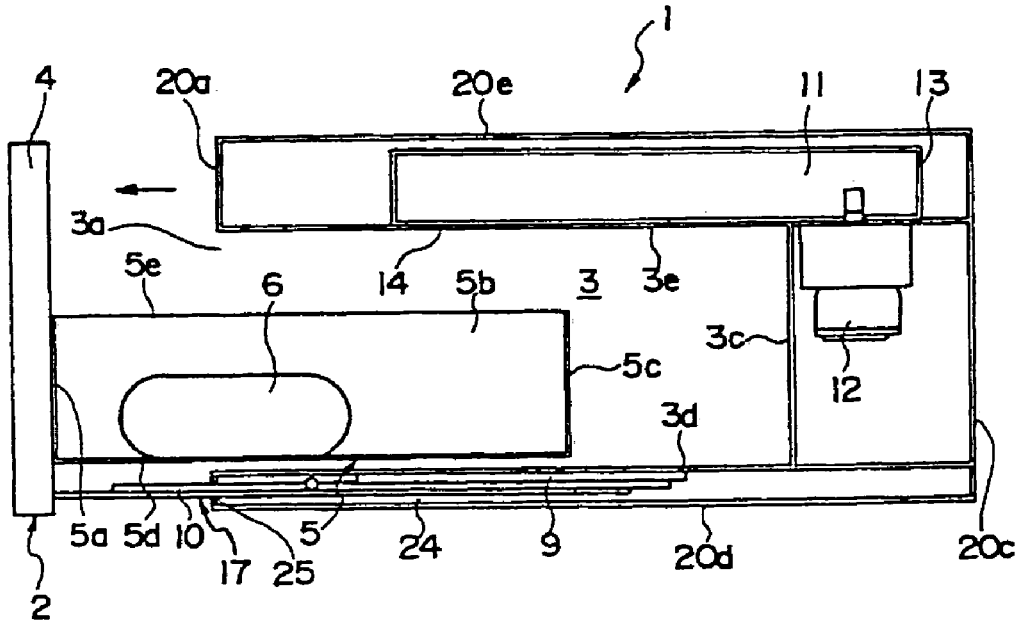
FIG. 2 is a vertical cross-sectional view of the drawer-type heat cooker shown in FIG. 1.
Figure 3:
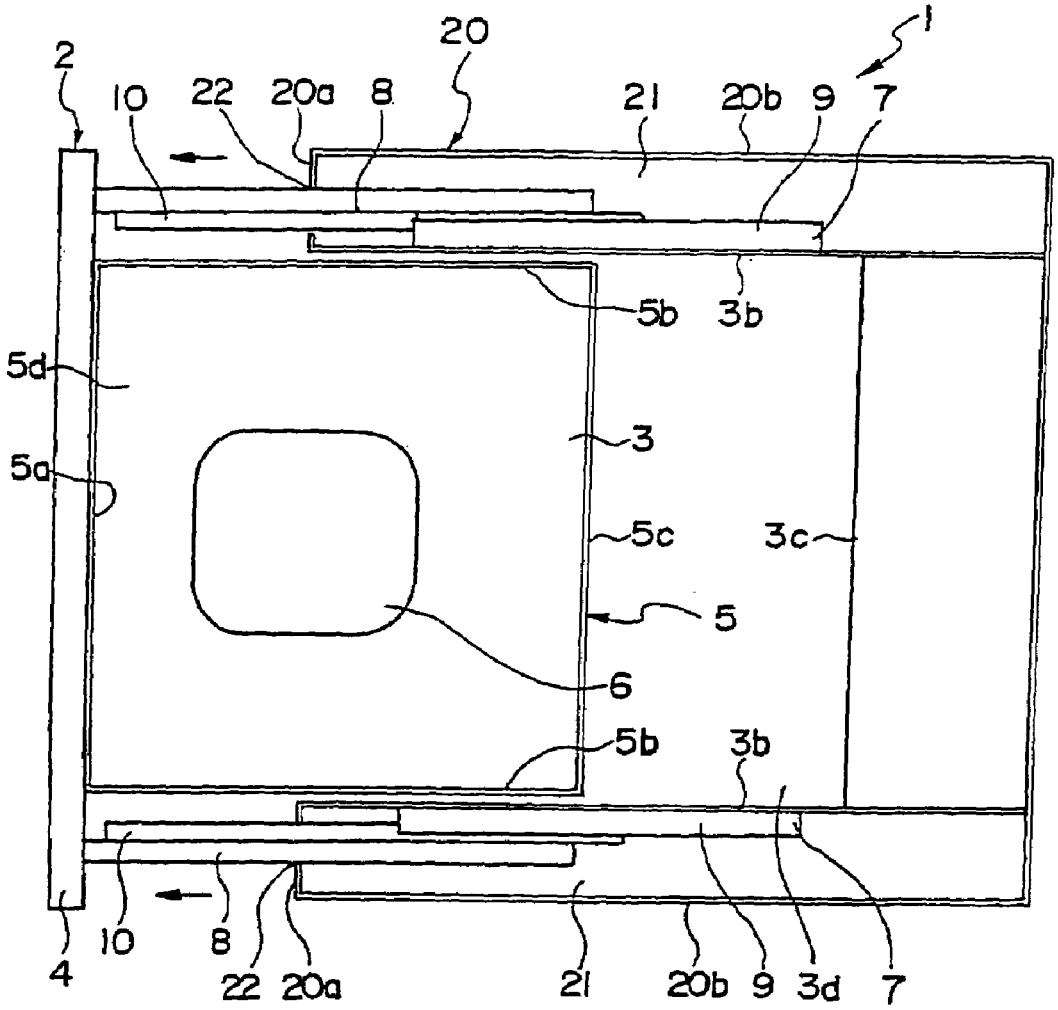
FIG. 3 is a horizontal cross-sectional view of the drawer-type heat cooker shown in FIG. 1.
Figure 4:
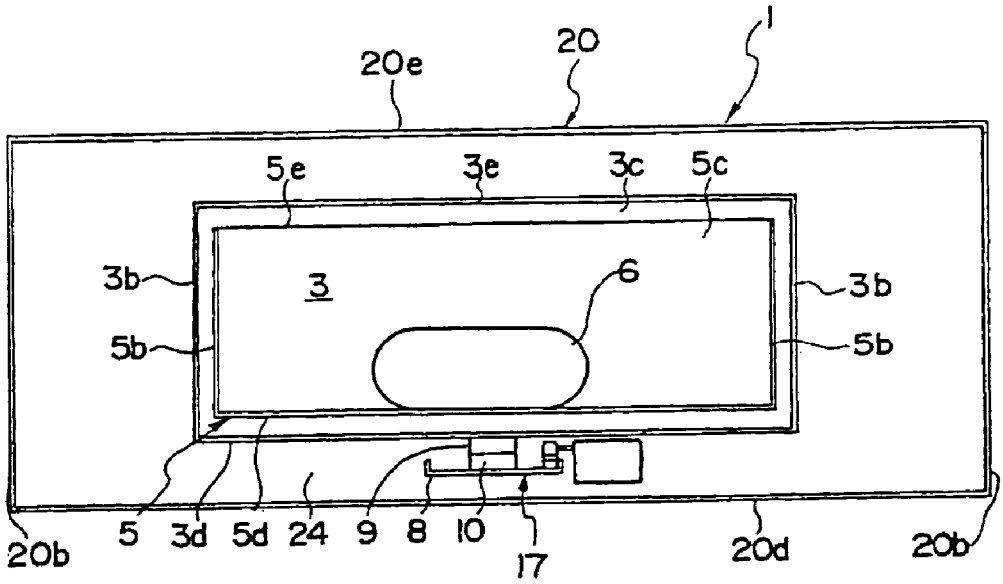
FIG. 4 is a lateral cross-sectional view of the drawer-type heat cooker shown in FIG. 4.
Figure 5:
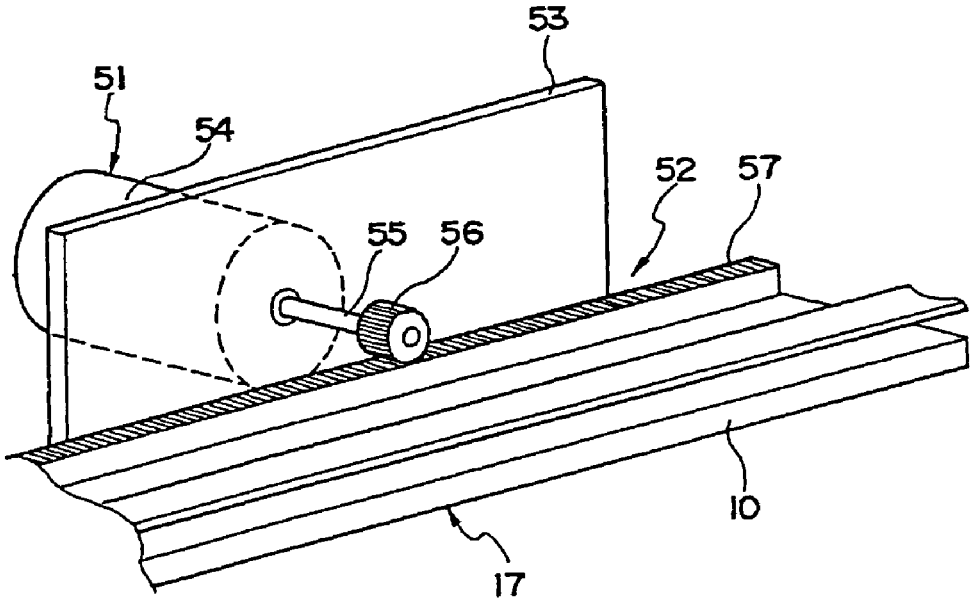
FIG. 5 is a perspective view of an example of a drive mechanism used in the drawer-type heat cooker shown in FIG. 1.

Referring now to accompanied drawings, an embodiment of a drawer-type heat cooker according to the invention will be described. FIG. 1 is a perspective view partly broken of a general appearance of an embodiment of a drawer-type heat cooker according to the invention; FIG. 2 is a vertical cross-sectional view of the drawer-type heat cooker shown in FIG. 1; FIG. 3 is a horizontal cross-sectional view of the drawer-type heat cooker shown in FIG. 1; FIG. 4 is a lateral cross-sectional view of the drawer-type heat cooker shown in FIG. 1; and FIG. 5 is a schematic perspective view of the drive mechanism used in the portion indicted by a character A in the drawer-type heat cooker shown in FIG. 1. In FIG. 2, a sliding mechanism on the outside below the center is schematically shown, and in FIG. 4, left and right sliding mechanism is omitted.

As shown in FIG. 1 to FIG. 4, the drawer-type heat cooker (hereinafter, referred to simply as "heat cooker") includes a cooker body 1 and a drawer body 2 which can be drawn out from the cooker body 1. Within the cooker body 1, a heat chamber 3 for cooking an object 6 to be cooked placed on the drawer-body 2 is defined. The heat chamber 3 has an opening 3*a* on the front side, and is defined by left and right side walls 3*b*, 3*b*, a rear wall 3*c* which is connected to the side walls 3*b*, 3*b* on the back (inner) side, and a bottom wall 3*d* and a top wall 3*e* connected to the side walls 3*b*, 3*b* and the rear wall 3*c*.

The drawer body 2 is disposed movably in the cooker body 1 by a sliding mechanism, described later, so that it can be drawn out toward the front outside from the heat chamber 3 of the cooker body 1 in the direction indicated by arrows (FIG. 2, FIG. 3). The drawer body 2 includes an opening-closing door 4 for opening and closing the heat chamber 3 and a heating container 5 to which the opening-closing door 4 is mounted and which stores the object 6 to be heated in the placed state. The heating container 5 includes a front plate 5*a* to be mounted to the opening-closing door 4, side plates 5*b*, 5*b* on the left and right sides extending from the left and right of the front plate 5*a* toward the rear, a rear plate 5*c* connected to the side plates 5*b*, 5*b* on the rear (inner) side, and a bottom plate 5*d* connected to the side plates 5*b*, 5*b* and the rear plate 5*c*, and is formed with a container opening 5*e* through which the object 6 to be heated can be put in and taken out on top thereof.

The drawer-body 2 can be moved between a drawn-out position where the heating container 5 is drawn out forward from the heat chamber 3 (corresponds to the drawn state in FIG. 1) and a stored position where the heating container 5 is stored in the heat chamber 3. The heat cooker includes slide rails 7, 7 as left and right sliding mechanism disposed on the outsides on the left and the right sides of the heat chamber 3, and a slide rail 17 as a central sliding mechanism disposed on the outside below the center of the heat chamber 3. Since it is adapted in such a manner that the opening-closing door 4 takes a position to close the opening 3*a* of the heat chamber 3 when the drawer body 2 is at the stored position, the inner space of the heat chamber 3 becomes a sealed space by the inner wall surface of the cooker body 1 and the drawer body 2, and hence microwave irradiated in the heat chamber 3 is prevented from leaking out. When the drawer body 2 is at the drawn-out position, the heating container 5 is drawn out toward the front sufficiently from the heat chamber 3, whereby the object 6 to be heated can be put in and taken out from the heating container 5 through the container opening 5*e*.

The respective slide rails 7, 17 includes fixed rails 9 to be mounted to the cooker body 1 side and movable rails 10 mounted to the drawer body 2 side and slidable along the fixed rail 9. These slide rails 7, 17 may be those having the similar slide rails used for office furniture such as cabinets and desks, and description in detail is omitted. As shown in FIG. 3 or FIG. 4, the respective fixed rails 9 are mounted to the outside of the side walls 3*b*, 3*b*, 3*d* which define the heat chamber 3 of the cooker body 1. The respective movable rails 10 are mounted to the opening-closing door 4 via an L-shaped angle members 8 mounted in a state of extending from the inner wall surface of the opening-closing door 4 of the drawer body 2 toward the cooker body 1.

In the cooker body 1, a microwave generating device 11 is disposed around the heat chamber 3. The microwave generating device 11 includes a magnetron 12 disposed behind the heat chamber 3 for generating microwave and a wave guide tube 13 disposed above the heat chamber 3 for transmitting the microwave generated by the magnetron 12. The microwave generated by the magnetron 12 passes through the wave guide tube 13 and is irradiated from a power supply port 14 into the heat chamber 3.

The left and right slide rails 7 are provided in conjunction with passage boxes 21 formed in the cooker body 1 on the left and right sides of the heat chamber 3 respectively. In other words, the cooker body 1 includes a front wall 20*a*, left and right side walls 20*b*, 20*b*, a rear wall 20*c*, a bottom wall 20*d* and a top wall 20*e* around the opening 3*a* of the heat chamber 3 as an enclosure 20. In the cooker body 1, the passage boxes 21 which are each surrounded by the side walls 20*b*, 20*b*, the front wall 20*a*, the rear wall 20*c*, the bottom wall 20*d*, and part of the top wall 20*e* of the enclosure 20 are formed outside the side walls 3*b* of the heat chamber 3. The fixed rails 9 of the respective slide rails 7 are mounted in a passage boxes 21 outside the side walls 3*b* of the heat chamber 3, and the movable rails 10 can be moved in and out from the passage boxes 21 through insertion holes 22 formed on the front wall 20*a* together with the L-shaped angle members 8. The slide rail 17 at the center is provided in conjunction with the passage box 24 (FIG. 4) formed in the cooker body 1 outside below the center of the heat chamber 3. In other words, in the cooker body 1, the passage box 24 is defined between the bottom wall 20*d* of the enclosure 20 and the bottom plate 3*d* of the heat chamber 3, and the slide rail 17 is disposed in the passage box 24 together with the drive mechanism, described below. The slide rail 17 can also move in and out from the passage box 24 through an insertion hole 25 formed on the front wall 20*a*.

As shown in FIG. 4 and FIG. 5, a drive mechanism 50 is disposed in conjunction with the slide rail 17 at the center in order to open and close the drawer body 2 automatically. The drive mechanism 50 includes a drive motor 51 as a drive source and a rack-pinion mechanism 52 for transmitting the rotational output of the drive motor 51 to the movable rail 10. The drive motor 51 includes a motor body 54 mounted to a motor mounting angle member 53 fixed to the fixed rail 9, a motor shaft 55 as a rotary output shaft extending from the motor body 54. The rack-pinion mechanism 52 as a transmitting mechanism includes a pinion 56 mounted at a distal end of the motor shaft 55 and a rack 57 to be meshed with the pinion 56. The rack 57 is disposed on the movable rail 10 along the direction of movement of the drawer body 2, and the motor shaft 55 extends in the direction orthogonal to the direction of extension of the rack 57.

Since the slide rails 7, 17 are provided outside the heat chamber 3 so as to be capable of moving in and out from the passage boxes 21, 24 through the insertion holes 22, 25, it is not necessary to use expensive components or material having high heat-resistant property and fire-resistant property as the L-shaped angle member 8 for constituting the respective slide rails, the fixed rails 9 and the movable rails 10. Therefore, the manufacturing cost of the heat cooker can be reduced. Also, the respective slide rails 7, 17 provided outside the heat chamber 3 are not affected by the microwave irradiated in the heat chamber 3, the risk of discharge caused by microwave is avoided. Since the drive mechanism 50 is also provided outside the heat chamber 3, it is not exposed in high temperature, and is not affected by the microwave irradiated in the heat chamber 3. In addition, leavings may be generated from the food to be put in the heat chamber 3 when putting in or taking out or when being heated, and attached to the sliding portion or the contact portion, which is one of causes of breakdown of the heat cooker. However, since the respective slide rails 7, 17 and the drive mechanism 50 are provided outside the heat chamber 3, such leavings of the food do not attach to the respective slide rails 7, 17 and the drive mechanism 50.

Therefore, occurrence of the breakdown caused by the attached leavings of the food can be prevented in advance.

Since the drawer body 2 is supported by the cooker body not only via the left and right slide rails 7, 7, but also, particular, via the slide rail 17 at the center, the drawer body 2 can be drawn out stably from the heat chamber without being inclined toward the lower front when being drawn out. When the drawer body 2 can be supported and guided sufficiently with the slide rail 17 at the center, the left and right slide rails 7, 7, can be omitted. Although the drive mechanism 50 is applied to the slide rail 17 at the center in the example, it is not limited thereto, and the drive mechanisms may be provided separately for the left and right slide rails 7, 7 and driven synchronously.

What is claimed is:

1. A drawer-type heat cooker comprising:

a cooker body including a heat chamber for heating with microwave therein;

a drawer body movably disposed between a stored position in the heat chamber and a drawn-cut position outside the heat chamber with respect to the cooker body;

a sliding mechanism enabling the drawer body to move with respect to the cooker body; and a drive mechanism for driving the sliding mechanism, wherein the sliding mechanism and the drive mechanism are arranged outside the heat chamber, the sliding mechanism comprises a central sliding mechanism disposed outside below the center of the heat chamber, and left and right sliding mechanisms arranged on the outside on the left and right sides of the heat chamber, each sliding mechanism comprises a fixed rail mounted to the cooker body and a movable rail attached to the drawer body and being movable relatively with respect to the fixed rail, and the drive mechanism drives the central sliding mechanism, and said drive mechanism comprises a drive motor mounted to the cooker body and a rack-pinion mechanism including a pinion to be rotated b the drive motor and a rack mounted to the movable rail of the central sliding mechanism and meshed with the pinion.

2. The drawer-type heat cooker according to claim 1, wherein the drawer body comprises a heating container, and an opening-closing door mounted to the heating container and mounted with the movable rail, and an opening of the heat chamber is closed by the opening-closing door and the heating container is stored in the heat chamber in a state in which the drawer body is in the stored position.

3. The drawer-type heat cooker according to claim 1, wherein the cooker body includes a front panel for surrounding defining the opening of the heat chamber with which the opening-closing door comes into abutment in a state in which the drawer body is in the stored position, and the movable rail can be moved in and out from the cooker body through an insertion hole formed on the front panel.

* * * * *